US010105556B2

(12) United States Patent
Simmonds

(10) Patent No.: US 10,105,556 B2
(45) Date of Patent: Oct. 23, 2018

(54) RESPIRATOR FILTER INTERFACE

(71) Applicant: Scott Technologies, Inc., Boca Raton, FL (US)

(72) Inventor: Edward Powers Simmonds, Indian Trail, NC (US)

(73) Assignee: Scott Technologies, Inc., Boca Raton, FL (US)

( * ) Notice: Subject to any disclaimer, the term of this patent is extended or adjusted under 35 U.S.C. 154(b) by 442 days.

(21) Appl. No.: 14/853,065

(22) Filed: Sep. 14, 2015

(65) Prior Publication Data

US 2016/0001107 A1 Jan. 7, 2016

Related U.S. Application Data

(63) Continuation of application No. PCT/US2014/027088, filed on Mar. 14, 2014.
(Continued)

(51) Int. Cl.
*A62B 9/04* (2006.01)
*A62B 23/02* (2006.01)

(52) U.S. Cl.
CPC ..... *A62B 9/04* (2013.01); *A62B 23/02* (2013.01)

(58) Field of Classification Search
CPC ..... A62B 9/04; A62B 23/02; A61M 16/105; A61M 16/047; A61M 16/22
See application file for complete search history.

(56) References Cited

U.S. PATENT DOCUMENTS 2,652,828 A * 9/1953 Matheson ..... A62B 18/00 128/201.19
4,111,197 A * 9/1978 Warncke ..... A62B 9/04 128/202.27

(Continued)

FOREIGN PATENT DOCUMENTS

CN 1901974 A 1/2007
CN 101052441 A 10/2007

(Continued)

OTHER PUBLICATIONS

Chinese Office Action and English translation of same dated Apr. 21, 2017 issued in corresponding Chinese Patent Application No. 201480025195.3, consisting of 13-pages.

*Primary Examiner* — Steven Douglas
(74) *Attorney, Agent, or Firm* — Christopher & Weisberg, P.A.

(57) ABSTRACT

A respirator filter connection mechanism with a first attachment element, the first attachment element associated with a respirator mask. The mechanism has a second attachment element which is associated with a filter. It also has openings provided through the first and second attachment elements and configured to be aligned with an inlet or discharge port of the mask and an inlet or discharge port of the filter. One of the first and second attachment elements includes a spring element located proximate to a corresponding opening, while another the first and second attachment elements includes an attachment shelf located proximate to a corresponding opening. The spring element is configured to be linearly advanced into initial engagement with the attachment shelf until the spring element and attachment shelf couple to one another in an intermediate loaded position. The attachment shelf has a cam feature that slidably engages the spring element and pulls the spring element from the intermediate loaded position into a locked and sealed posi- (Continued)

tion as at least one of the attachment shelf and spring element is rotated relative to the other of the attachment shelf and spring element.

15 Claims, 6 Drawing Sheets

Related U.S. Application Data

(60) Provisional application No. 61/792,813, filed on Mar. 15, 2013.

(56) References Cited

U.S. PATENT DOCUMENTS

| | | | | |
|---|---|---|---|---|
| 4,932,399 | A | 6/1990 | Cappa et al. | |
| 5,062,421 | A | 11/1991 | Burns et al. | |
| 5,224,474 | A | 7/1993 | Bloomfield | |
| RE35,062 | E * | 10/1995 | Brostrom | A62B 18/08 128/206.12 |
| 5,640,952 | A * | 6/1997 | Swann | A62B 7/10 128/204.27 |
| 6,497,756 | B1 | 12/2002 | Curado et al. | |
| RE39,493 | E | 2/2007 | Yuschak et al. | |
| D541,413 | S | 4/2007 | Jarvinen et al. | |
| 7,320,722 | B2 * | 1/2008 | Mittelstadt | A62B 9/04 128/202.27 |
| 9,700,743 | B2 * | 7/2017 | Castiglione | A62B 9/04 |
| 2005/0145249 | A1 | 7/2005 | Solyntjes et al. | |
| 2007/0289592 | A1 | 12/2007 | Sutton et al. | |
| 2008/0035149 | A1 | 2/2008 | Sutton | |
| 2008/0257352 | A1 | 10/2008 | Penton et al. | |
| 2009/0193936 | A1 | 8/2009 | Lu et al. | |
| 2013/0125896 | A1 * | 5/2013 | Dwyer | A62B 18/02 128/206.17 |

FOREIGN PATENT DOCUMENTS

| | | | |
|---|---|---|---|
| CN | 101784304 | A | 7/2010 |
| CN | 102022402 | A | 4/2011 |
| EP | 916369 | B1 | 1/2012 |
| JP | H11 99214 | A | 4/1999 |
| KR | 10-0914302 | B1 | 9/2009 |
| KR | 10-2010-0010322 | A | 2/2010 |
| KR | 10-0951399 | B1 | 4/2010 |
| WO | 2005089874 | A1 | 9/2005 |
| WO | 2009066833 | A1 | 5/2009 |
| WO | 2010131031 | A2 | 11/2010 |
| WO | 2013019764 | A2 | 2/2013 |

* cited by examiner 114
134
K
118
124
120
130
141
140
118
191

179
130
140
114
156
138
118
156
138
118
156
120
175

114
156
118
156
130
120

118
130
120
114
156
154

114
179
140
121
143
118
154
143
121
130
120
175

RESPIRATOR FILTER INTERFACE

CROSS-REFERENCE TO RELATED APPLICATIONS

This application is a continuation of International Patent Application No. PCT/US2014/027088 filed Mar. 14, 2014, which claims the benefit of U.S. Provisional Application No. 61/792,813 filed on Mar. 15, 2013, the contents of both of which are incorporated herein by reference.

FIELD OF THE EMBODIMENT

Embodiments described herein generally relate to respiration masks and filters and more particularly to removable filter attachments between respirator masks and filters.

BACKGROUND OF THE EMBODIMENT

Filter attachments on existing respirator masks, while providing an air-tight seal, suffer from various shortcomings related to ease-of use. Some types of attachments must be carefully oriented at a precise angle to initiate installation. Other types require careful orientation and multiple turns, or precise placement and strenuous stretching.

Replaceable respirator filter cartridges are required to allow installation of the filter to the mask without the use of additional tools. Existing respirators have numerous methods of filter attachment requiring use of the hands only (no tools), and which provide a robust airtight seal once the filter is attached. Three of the commonly used attachment methods are threaded, bayonet, and flexible flange. The existing threaded types require correct orientation to align the threads to begin engagement, followed by multiple rotations to fully attach the filter.

The existing bayonet types require precise alignment of the male and female elements of the connection, followed by ¼ turn to fully attach the filter. Bayonet connections are commonly shown to be confusing to orient at the precise correct angle to initiate installation, particularly for inexperienced users.

The flexible flange types have an elastomeric element which must be manipulated (bent and/or stretched) in a precise manner in conjunction with the filter, sometimes with considerable strength, to effect the attachment of the filter to the mask.

SUMMARY

In accordance with an embodiment, a respirator filter connection mechanism is provided that comprises a first attachment element, the first attachment element is associated with a respirator mask. A respirator filter connection mechanism also comprises a second attachment element, the second attachment element associated with a filter; openings provided through the first and second attachment elements and configured to be aligned with an inlet or discharge port of the mask and an inlet or discharge port of the filter. One of the first and second attachment elements includes a spring element located proximate to a corresponding opening, while another the first and second attachment elements includes an attachment shelf located proximate to a corresponding opening. The spring element is configured to be linearly advanced into initial engagement with the attachment shelf until the spring element and attachment shelf couple to one another in an intermediate loaded position. The attachment shelf has a cam feature that slidably engages the spring element and pulls the spring element from the intermediate loaded position into a locked and sealed position as at least one of the attachment shelf and spring element is rotated relative to the other of the attachment shelf and spring element.

Optionally, the attachment elements of the mechanism may include based areas having mating faces that extend about the attachment shelf and spring element, the attachment shelf and spring element drawing the mating faces into sealed direct contact with one another as the first and second attachment elements are rotated relative to one another.

Alternatively, the mechanism may include the attachment shelf which includes a wall and the cam feature which includes a ledge provided on the wall, the spring element including a locking indentation that slides along the ledge to pull the first and second attachment elements into a locked and sealed position. Optionally, the mechanism may include a spring element which includes a U or C-shaped clip having locking indentations provide at outer distal ends thereof, the U or C-shaped clip fitting into a notch provided in one of the first and second attachment elements, the locking indentations engaging the cam feature. Alternatively, the mechanism may include the attachment shelf, which includes a base area extending laterally outward about a longitudinal axis, the attachment shelf further including a male nipple shaped flange element projecting from the base area in along the axis, the flange element including the am feature, the cam feature including an embossment extending circumferentially about the flange element.

Optionally, the mechanism may include the spring element which includes snap pins that extend outward from the first attachment element, the snap pins having lever arms that flex inward toward one another to pass through the opening in the second attachment element and through the attachment shelf, the snap pins including hooking portions that hook over the cam feature on the attachment shelf. Alternatively, the mechanism may include the second attachment element which includes a base area extending about a longitudinal axis, the attachment shelf including walls that project from the base area and along the axis, the walls including a ledge forming the cam feature. Alternatively, the mechanism may include the spring element which includes locking indentations that travel along the ledge to pull mating faces of the corresponding attachment elements toward one another in a sealing direction, an inter-operation of the ledge and the spring element introducing a sealing force applied between the first and second attachment elements during a rotational locking motion.

In accordance with another embodiment, a method is described for connecting a respirator and a filter that comprises providing a first attachment element associated with a respirator mask, providing a second attachment element associated with a filter and aligning openings through the first and second attachment elements aligned with an inlet or discharge port of the mask and an inlet or discharge port of the filter. The method also comprises locating a spring element proximate to a corresponding opening in one of the first and second attachment elements, locating an attachment shelf proximate to a corresponding opening in another of the first and second attachment elements and linearly advancing the spring element into initial engagement with the attachment shelf until the spring element and attachment shelf couple to one another in an intermediate loaded position. The method also comprises rotating at least one of the spring element and attachment shelf relative to one another to cause the cam feature on the attachment shelf to slidably engage the spring element and pull the spring element from the intermediate loaded position into a locked and sealed position.

Optionally, the method may further comprise drawing mating faces on the first and second attachment elements into sealed direct contact with one another as the first and second attachment elements are rotated relative to one another. Alternatively, the method may include the attachment shelf which includes a wall and the cam feature which includes a ledge provided on the wall, the spring element including a locking indentation that slides along the ledge to pull the first and second attachment elements into a locked and sealed position. Alternatively, the method may include the spring element which includes a U or C-shaped clip having locking indentations provide at outer distal ends thereof, the U or C-shaped clip fitting into a notch provided in one of the first and second attachment elements, the locking indentations engaging the cam feature.

Alternatively, the method may include the attachment shelf which includes a base area extending laterally outward about a longitudinal axis, the attachment shelf further including a male nipple shaped flange element projecting from the base area in along the axis, the flange element including the cam feature, the cam feature including an embossment extending circumferentially about the flange element. Optionally, the method may include the spring element which includes snap pins that extend outward from the first attachment element, the snap pins having lever arms that flex inward toward one another to pass through the opening in the second attachment element and through the attachment shelf, the snap pins including hooking portions that hook over the cam feature on the attachment shelf.

Alternatively, the method may further comprise linearly advancing the spring element and attachment shelf toward one another from a pre-loaded stage to an intermediate loaded stage, rotating the spring element and attachment shelf relative to one another to advance from the intermediate loaded stage to the sealed and locked stage.

DETAILED DESCRIPTION OF THE PREFERRED EMBODIMENT

Figure 1:
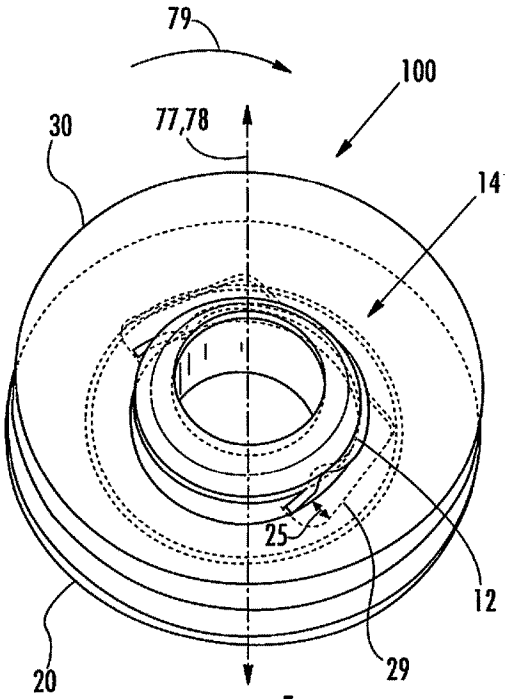
FIG. 1 illustrates a perspective view of a respirator filter connection mechanism in accordance with an embodiment.

FIGS. 1-17 illustrate embodiments for a respirator filter connection mechanism 100 that utilizes an attachment of a spring element 12 to an attachment shelf, which allows the filter to be snapped on at almost any initial angular position relative to the mask, then twisted, such as between ¼ and ½ turn, to a final sealed and locked position. Removal of the filter requires approximately ¼ turn and simultaneously outward pulling the filter, but the mechanism 100 also allows some leeway in the orientation between the filter and mask for removal. As examples, the filter attachment attaches to an elastomeric half-mask or full mask respirator. Examples of masks and filters that may use the mechanism 100 described herein include, but are not limited to, U.S. Pat. No. 541,413S1; US20080035149A1; US20070289592A1; EP916369B1; WO2010131031A3; and WO2005089874A1, all of which are expressly incorporated herein by reference in their entireties. In one embodiment, the spring element 12 is formed from a metal spring or clip, shown in FIGS. 1-6, as the means for clipping onto an attachment shelf 14 which is formed from a male nipple shaped flange element 42. In another embodiment, the spring element 118 includes flexible cantilever snap pins, such as plastic, which can be molded as an integral piece of the mask or filter structure, rather than requiring a separate part, shown in FIGS. 7-14, 16 and 17. In the second embodiment, fewer parts and fewer assembly operations are used as well as a reduced design height of the assembly which allows increased location options for a mechanical stop and/or adding a detent mechanism.

FIG. 1 illustrates a perspective view of a respirator filter connection mechanism 100 formed in accordance with an embodiment herein. The connection mechanism 100 includes first and second attachment elements 20 and 30 that are configured to be joined to an air inlet/discharge part of a mask and an air inlet/discharge of a filter, respectively. A subset of the components within the connection mechanism 100 are shown in FIG. 1 in dashed lines, namely, a spring element 12 and an attachment shelf 14 that directly contacts the spring element 12 to retain the attachment elements 20 and 30 sealably engaged with one another. As one example, the spring element 12 may constitute a metal spring, as shown in more detail in FIG. 5, while the attachment shelf 14 may be formed as a male nipple shaped flange element 42, as shown in FIGS. 3, 4 and 6.

Figure 2:
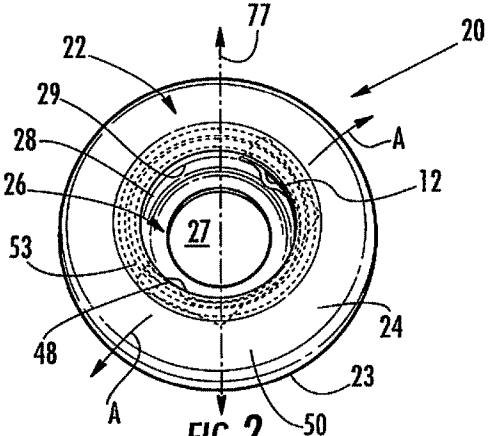
FIG. 2 illustrates an end perspective view of the attachment element formed in accordance with an embodiment.

The spring element 12 may be incorporated into a filter or mask component, shown in FIG. 2. FIG. 3 shows the spring element only, with other parts omitted for clarity, attached to the opposite male side of a filter or mask. Referring to FIG. 2, the spring element 12 snaps into a notch 29 to become an integral part of the assembly. As seen in FIG. 1, the notch 29 is shaped to hold the spring element 12 in a manner to resist rotation during use (e.g., ends 60 and arms 64 of the spring element 12 abut against a wall of the notch 29 to prevent rotation there between). Also shown is an elastomer sealing surface 48.

Figure 3:
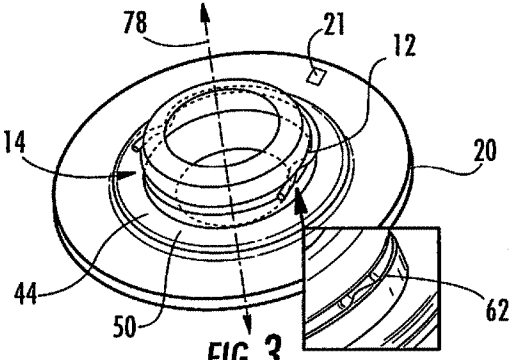
FIG. 3 illustrates a mask or filter component.
Figure 4:
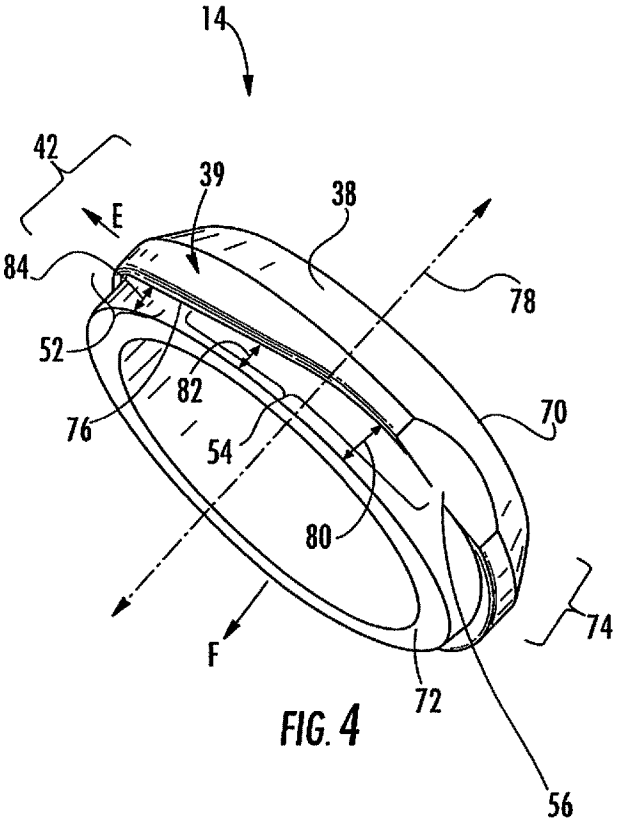
FIG. 4 illustrates a side perspective view of the flange element.
Figure 7:
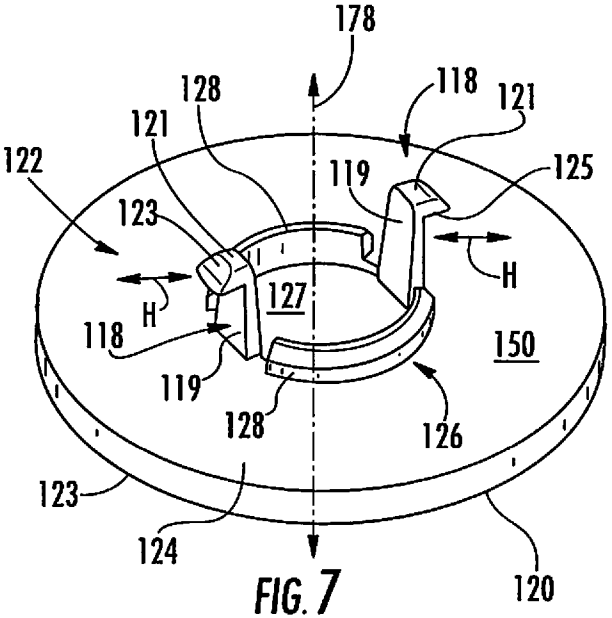
FIG. 7 illustrates an attachment element formed in accordance with an alternative embodiment.

The embodiment of FIGS. 1-3 includes two attachment elements, a first attachment element 20 on the respirator mask and a second attachment element 30 on the filter. One element 20 "clips on" by flexing of the spring element 12 to effect attachment to an attachment shelf 14 of the other element 30, as shown in FIG. 7. Although functionality of the elements 20, 30 identifies the spring element 12 on one particular element, and the attachment shelf 14 on the other particular element, the structure and functionality of each element 20, 30 may be reversed. Optionally, the spring element 12 can have various configurations, such as for example without limitation, the spring element may include a flexible clip, a snap pin, or other tensioning mechanism for releasable attachment. The other attachment element 20, 30 includes the shelf 14 to which the spring element 12 attaches.

FIG. 2 illustrates an end perspective view of the attachment element 20 formed in accordance with an embodiment. The attachment element 20 includes a base area 22 laterally extending from a longitudinal axis 77 and having a back face 23 that is configured to be fixedly mounted to an inlet/discharge port of a mask or filter. The base area 22 includes a mating face 24 that is configured to be coupled to a releasable sealable interface with the second attachment element 30. The attachment element 20 includes a central mating cavity 26 with an opening 27 extending there through centered about the axis 77. The opening 27 is configured to permit passage of air/fluid through the interface between inlet/discharge ports of the filter and mask. The mating cavity 26 includes a peripheral wall 28 extending circumferentially thereabout. The wall 28 includes at least one spring element retention notch 29 extending about an interior of the wall 28. The notch 29 has a thickness dimensioned to receive the spring element 12. The notch 29 includes a depth (extending radially away from the axis 77 of the cavity 26) sufficient to permit the spring element 12 to flex in an outward radial direction (as denoted by Arrows A) when loading and unloading the filter from the mask (also referred to as attaching/detaching or engaging/disengaging the spring element 12 from the shelf 14). FIG. 1 illustrates an exemplary shape for the notch 29, including a depth 25 that permits arms 64 to move radially during the loading and unloading operations. The shape of the notch 29 and shape of the spring element 12 prevent relative rotation therebetween, to prevent spinning of the spring element 12 with reference to the attachment element 20.

Figure 5:
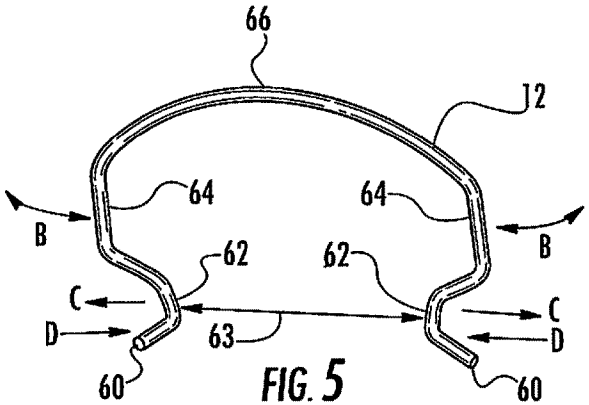
FIG. 5 illustrates a spring element formed in accordance with an embodiment herein.
Figure 6:
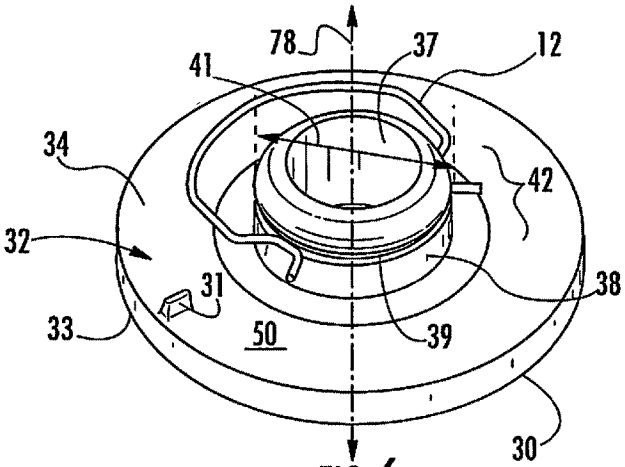
FIG. 6 illustrates the second attachment element formed in accordance with an embodiment.

FIG. 5 illustrates a spring element 12 formed in accordance with an embodiment herein. The spring element 12 may constitute a metal or plastic spring or clip, a molded rubber full or partial ring and the like. In FIG. 5, the spring element includes a generally U-shape or C-shape with open opposed ends 60 that are spaced apart from one another. The U or C shaped spring element 12 is defined by a bent transition linking segment 66 that is joined at opposite ends to lever arms 64. The lever arms 64 include locking indentations 62 provided on distal ends thereof and proximate to the ends 60 of the spring element 12. The locking indentations 62 are bent to flare radially inward toward one another (relative to the arms 64) and are separated by a first distance 63 when in an unbiased/resting state.

During an initial loading operation, in which the attachment elements 20, 30 are moved from an unmated stage/position to a partially mated stage/position, the locking indentations 62 contact a portion of the mating attachment element 20, 30 and are deflected outward, in the direction of Arrows C within the depth 25 of the notch 29, to a bias or non-resting flared state. The attachment elements 20, 30 are advanced linearly toward one another (along the longitudinal axis 77 and 78 (FIGS. 1-3) during the initial loading operation until reaching an intermediate loaded stage/position. As the attachment elements 20, 30 linearly advance toward one another, the locking indentations 62 move outward as the lever arms 64 rotatably flex outward along Arrow B to permit the shelf 14 to pass. An amount of flex is based in part on the overall geometry of the lever arms 64 and transition linking segment 66. Upon reaching the intermediate loaded stage/position, the locking indentations 62 return inward toward one another (along Arrows D) toward their unbias/resting state.

FIG. 6 illustrates the second attachment element 30 formed in accordance with an embodiment. The attachment element 30 includes a base area 32 laterally extending from axis 78 that has a back side 33 that is configured to be fixedly mounted to an inlet/discharge port of a mask or filter. The base area 32 includes a mating face 34 that is configured to be coupled through a releasable sealed interface with the first attachment element 20 at seals 50. The attachment element 30 includes an attachment shelf 14 shaped as a flange element 42 that projects outward from the base area 32 in a cylindrical tubular shape about axis 78. The flange element 42 includes an opening 37 extending there through. The opening 37 is configured to permit passage of air/fluid through the interface between inlet/discharge ports of the filter and mask. The spring element 12 is configured to be linearly advanced into initial engagement with the attachment shelf 14 until the spring element 12 and attachment shelf 14 couple to one another in an intermediate loaded position. The attachment shelf 14 having a cam feature (e.g., embossment 39 and ledge 76) that slidably engage the spring element 12 and pulls the spring element 12 from the intermediate loaded position into a locked and sealed position as at least one of the attachment shelf 14 and spring element 12 is rotated relative to the other of the attachment shelf 14 and spring element 12.

FIG. 4 illustrates a side perspective view of the flange element 42 (without showing the base are 32). The flange element 42 includes a peripheral wall 38 extending circumferentially thereabout. The wall 38 includes at least one cam feature, namely an embossment 39 extending about an exterior of the wall 38. The embossment 39 has a thickness dimensioned (extending radially or laterally outward in the direction of Arrow E from the axis 78) to form a ledge 76. The embossment 39 has an outer diameter 41 that is greater than the distance 63 between the locking indentations 62 when the spring element 12 is in the unbias/resting state. The flange element 42 includes a rear end 72 to which the base area 32 is mounted and a mating distal end 70 configured to be loaded into cavity 26. The embossment 39 is located at an intermediate distance (generally denoted by bracket 74) from the mating end 70. The ledge 76 faces the rear end 72 and is directed away from the mating distal end 70. The ledge 76 includes a loading zone 54 in which locking indentations 62 of the spring element 12 expand and travel over the embossment 39 until the locking indentations 62 clear the embossment 39 and snap into place under and against the ledge 76.

Optionally, the embossment 39 may include a gap or tapered zone 56 that is generally equal in diameter to a remainder of the peripheral wall 38 thereby permitting the spring element to readily pass through the zone 56.

The embossment 39 is formed with a varying height as measured parallel to the axis 78 along a transition region 54. The ledge 76 extends at varied heights above the rear edge 72 such that the ledge 76 is spaced different distances from the mating face 34 on the base area 32 at points about the wall 38. At the interface between the transition zone 54 and the gap 56, a first distance 80 is provided between the ledge 76 and the mating face 34 on the base area 32 (rear edge 72). The distance 82 between the ledge 76 and the mating face 34 decreases along the transition zone 54, until reaching the locking zone 52. Within the locking zone 52, the distance 84 between the ledge 76 and the mating face 34 (rear edge 72) is less (e.g., at a minimum) than the distances 82 and 80 at any other point along the transition zone 54. The distance 84 is set to establish a tight sealed interface between the mating faces 34 when in the fully locked stage/position.

Once the locking indentations 62 snap over the embossment 39, the locking indentations 62 travel along the ledge 76 as the attachment elements 20 and 30 is rotated (e.g., clockwise) relative to another, from the intermediate loaded stage/position to the final locked stage/position. The locking indentations 62 travel from the intermediate loaded position, when located at the gap 56 or transition zone 54, to the final locked stage/position when in the locking zone 52. As the locking indentations 62 travel along the ledge 76, the spring element 12 (and thus the mating face 24 on the attachment element 20) is pulled in the sealing direction F toward the rear edge 72 (and thus toward the mating face 34 on the base area 32). The inter-operation of the embossment 39 and the spring element 12 introduce a sealing force applied between the attachment elements 20, 30 during the rotational locking motion 79 (FIG. 1).

Optionally, the radial width of the embossment 39 may be varied at different points about the wall 38. For example, the ledge 76 may have a flange width that is greatest (e.g., a maximum) at the lowest height or distance 84 (corresponding to locking zone 52). The ledge 76 may have flange width that is less (relative to the flange width in the locking zone) within the transition zone 54. The ledge 76 may have a flange width that is zero within the gap 56.

Figure 8:
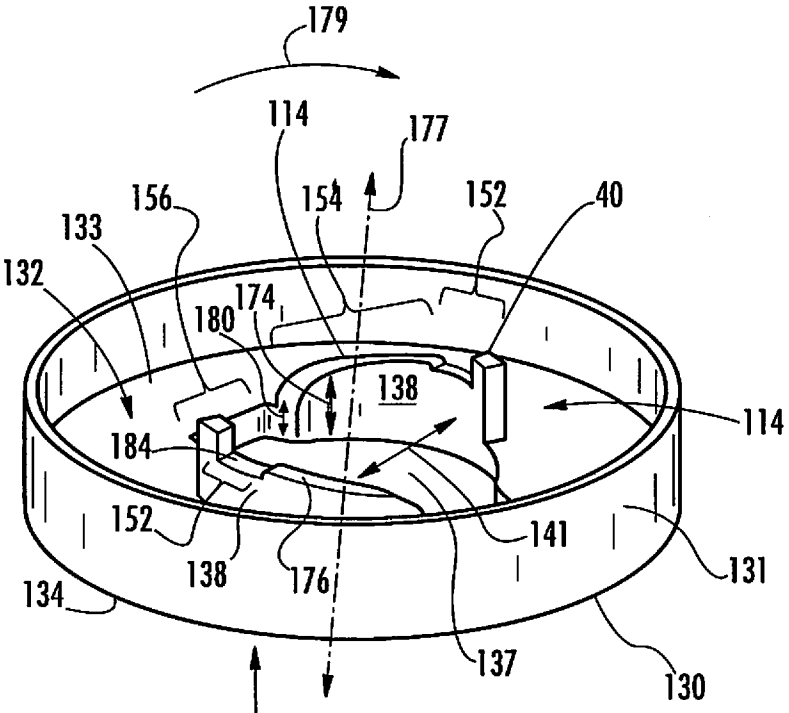
FIG. 8 illustrates a perspective view of the attachment element formed in accordance with an embodiment.

It should be realized that the embossment 39 and spring element 12 may have various configurations, including for example without limitation a gradually increasing attachment in both the radial and longitudinal/vertical directions, simultaneously, as shown in FIG. 4, or a gradually increasing attachment in the longitudinal/vertical direction only, as shown in FIG. 8. The combination of spring element 12 and attachment shelf 14 allows the filter to be engaged to the mask at a wide variation in angle, i.e., no precise orientation required, and then twisted a short way to the fully attached and sealed position.

Next, the discussion turns to an alternative embodiment in connection with FIGS. 7-14.

FIG. 7 illustrates an attachment element 120 formed in accordance with an alternative embodiment. The attachment element 120 includes a base area 122 laterally extending from longitudinal axis 177 and having a back side 123 that is configured to be fixedly mounted to an inlet/discharge port of a mask or filter. The base area 122 includes a mating face 124 that is configured to be coupled through a releasable sealed interface with the second attachment element 130. The attachment element 120 includes a central raised mating brace 126 with an opening 127 extending there through. The opening 127 is configured to permit passage of air/fluid between the interface between inlet/discharge ports of the filter and mask. The raised mating brace 126 includes opposed semi-circular flanges 128 extending circumferentially about the axis 178. The flanges 128 are spaced apart by opposed spring elements 118 that constitute snap pins that project upward from the base area 122. The spring elements 118 include legs 119 and upper hook portions 121. The hook portions extend in radially opposed directions away from the opening 127. The legs 119 flex radially inward and outward in the direction of Arrows H. The hook portions 121 include tapered faces 123 configured to facilitate engagement with a mating attachment element 130. The hook portions 121 include latching faces 125 configured to engage a corresponding feature on the attachment element 130. The legs 119 flex in an outward radial direction (as denoted by Arrows H) when loading and unloading the filter from the mask (also referred to as attaching/detaching or engaging/disengaging operations).

During an initial loading operation, in which the attachment elements 120 (FIG. 7) and 130 (FIG. 8) are moved line only from an unmated stage/position to a partially mated stage/position, the hook portions 121 contact a feature on the mating attachment element 130 and are deflected inward, along Arrows H, to a bias or non-resting state. The attachment elements 120, 130 are advanced linearly toward one another (along longitudinal axis 177, 178 (FIGS. 7 and 8) during the initial loading operation until reaching an intermediate loaded stage/position. As the attachment elements 120, 130 linearly advance toward one another, the hook portions 121 move inward as the legs 119 flex. An amount of flex is based in part on the overall geometry of the legs 119. Upon reaching the intermediate loaded stage/position, the hook portions 121 return outward away from one another (along Arrows H).

FIG. 8 illustrates a perspective view of the attachment element 130 formed in accordance with an embodiment. The attachment element 130 includes a laterally extending base area 132 having a back side 133 that is configured to be fixedly mounted to an inlet/discharge port of a mask or filter. The base area 132 includes a lateral rail 131 and an opposed mating face 134 that is configured to be coupled through a releasable sealed interface with the first attachment element 120. The attachment element 130 includes a pair of cam features which comprise attachment shelves 114 that project in the direction of the longitudinal axis 178 outward from the back side 133 of the base area 132 in a direction away from (and opposite to) the mating face 134. The cam features or shelves 114 wrap in a cylindrical or tubular shape about the axis 177. The base area 132 includes an opening 137 extending there through between the shelves 114. The opening 137 is configured to permit passage of air/fluid between the interface between inlet/discharge ports of the filter and mask.

Each of the shelves 114 includes a peripheral wall 138 extending circumferentially about the opening 137. The walls 138 includes an upper ledge 176 extending along an edge of the walls 138. The walls 138 are spaced apart by an inner diameter 141 that is substantially similar to a spacing 191 (FIG. 9) between outer surfaces of the legs 119 but less than the distance between the hook portions 121 when the spring elements 118 are in the unbias/resting state. The ledge 176 has a varying height is located at an intermediate distance (generally denoted by bracket 174) from the base area 132. The ledge 176 is directed away from the mating face 134. The ledge 176 includes a loading and transition zone 154 in which hook portions 121 of the spring elements 118 expand and travel over the wall 138 until the hook portions 121 clear the wall 138 and snap into place against the ledge 176.

Optionally, the wall 138 may include opposed gaps or slots 156 that define an opening having a diameter that is generally equal to or slightly larger than a diametric distance between outer most tips of the hook portions 121 thereby permitting the spring elements 118 to readily pass through the slots 156 during loading and/or unloading.

The ledge 176 is formed with a varying height as measured parallel to the axis 177 to define the transition and loading zone 154. The ledge 176 extends at varied heights above the base area 132 (as measure from the mating face 134 or back side 133) such that the ledge 176 is spaced different distances from the base area 132 at different points about the wall 138. At the interface between the transition zone 154 and the slots 156, a first distance 180 is provided between the ledge 176 and the base area 132. The distance 174 between the ledge 176 and the base area 132 decreases along the transition zone 154, until reaching the locking zone 152. Within the locking zone 152, notches 184 are provided in the ledge 176 to hold the hooking portions 121 once engaged.

The attachment elements 20, 30 includes a sealing barrier (e.g., a plastic or rubber seal). One or both of the attachment elements 20, 30 may include an elastomer sealing surface 50. Optionally, the cavity 26 may include a sealing bead 53 therein.

Next, the loading and sealing stages of the mating operation are explained in connection with FIGS. 9-14 and 16-18, in connection with the embodiment therein.

Figures 9, 10, 11, 12, 13:
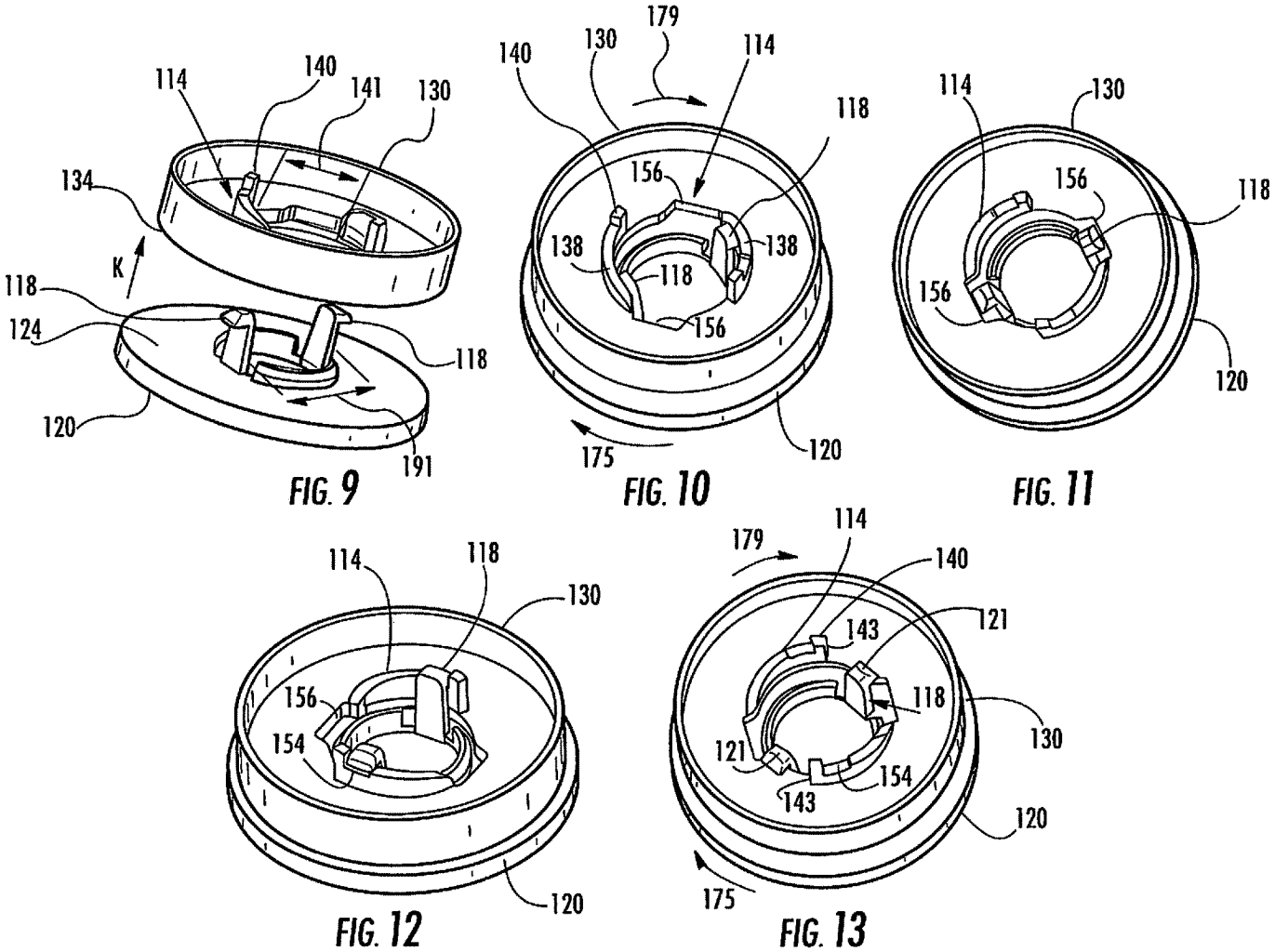
FIG. 9 illustrates the attachment elements aligned in a preloaded position with the spring element aligned to be accepted (and linearly introduced) through the opening in the attachment shelf.
FIG. 10 illustrates the attachment elements of FIG. 9.
FIG. 11 illustrates spring elements initially oriented to be aligned with the slots, separate from the wall.
FIG. 12 illustrates the attachment elements of FIG. 9 fully engaged in the sealed position.
FIG. 13 illustrates the attachment elements in the intermediate loaded position.

FIG. 9 illustrates the attachment elements 120, 130 aligned in a preloaded position with the spring element 118 aligned to be accepted (and linearly introduced) through the opening 127 in the attachment shelf 114.

During loading the attachment elements 120, 130 are linearly advanced toward one another in direct of Arrow K (parallel to the axis 177, 178). While advancing the attachment elements 120, 130, the hook portions 121 slide along interior surfaces of the wall 138 (as shown in FIG. 10) until the latching faces 125 hook over the ledge 176. In the example of FIGS. 9 and 10, the spring elements 118 are initially oriented to be aligned with the wall 138 along the transition zone 154, separate from (or outside of) the slots 156. The tapered faces 123 facilitate introduction at the orientation illustrated in FIGS. 9-10.

Optionally, the spring elements 118 may be initially oriented to be aligned with the slots 156, separate from the wall 138 such as illustrated in FIG. 11. The spring elements 118 are then rotated to follow the ledge 176 or to the position shown in FIG. 10.

Once the hooked portions 121 of the spring elements 112 clear the ledge 176, the attachment elements 120, 130 are in an intermediate loaded position.

Figure 16:
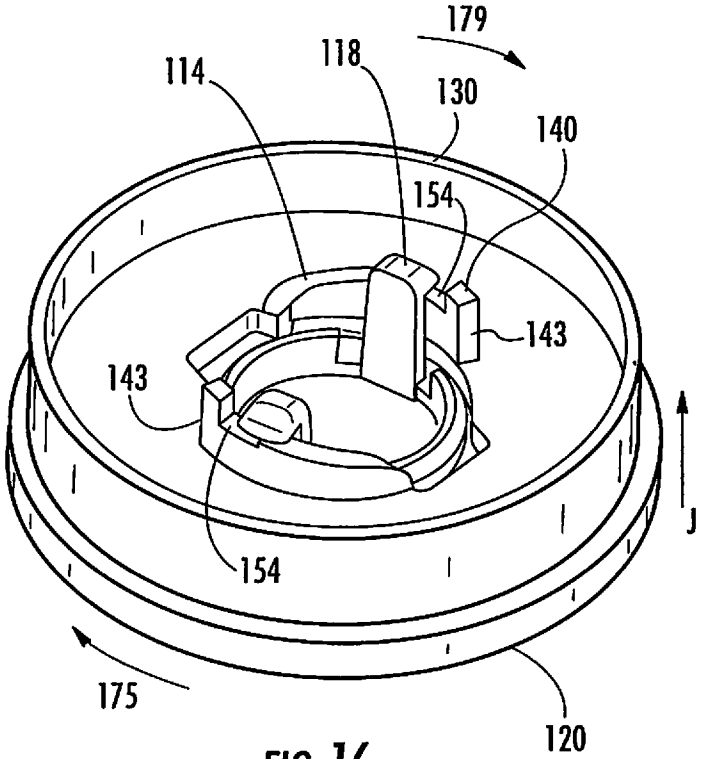
FIG. 16 illustrates the attachment elements in the intermediate loaded position.

FIGS. 13 and 16 illustrate the attachment elements 120, 130 in the intermediate loaded position. As shown in FIGS. 13 and 16, the attachment element 130 is rotated (such as clockwise or counter-clockwise) in the direction of arrow 179 and the attachment element 120 is rotated in the opposite direction of arrow 175, such that the hook portions 121 travel along the ledge 176.

The hook portions 121 travel from the intermediate loaded position (FIGS. 13 and 16), when located at the slots 156 or transition zone 154, to the final locked stage/position when in locking zone 152 (FIG. 12). As the hook portions 121 travel along the ledge 176, the mating brace 126 (and thus the attachment element 120) is pulled in the direction J (FIGS. 8 and 16) toward the ledge 176 (and thus toward the base area 132). The inter-operation of the ledge 176 and the spring elements 118 introduce a sealing force applied between the attachment elements 120, 130 during the rotational locking motion.

FIGS. 13 and 16 further illustrates posts 140 that are provided on distal ends of the walls 138. The posts 140 provide two functions. In connection with FIG. 13, once the spring elements 118 are inserted through the slots 156, in the event that a user incorrectly seeks to rotate the attachment elements 120, 130 in the wrong/reverse direction during a loading operation, the hooking portions 121 will rotate until abutting against the sides 143, thereby preventing further rotation in the wrong direction.

In connection with FIG. 16, the posts 140 serve as a stop to prevent the spring elements 118 from being rotated beyond the locking zones 154 (e.g., notches in the ledge 176). The hooking portions 121 drop into the notches or locking zones 154 and engage the posts 140 to afford a tactile "step" indication that is felt by the user to indicate to the user that the attachment elements 120, 130 are fully engaged and sealed with one another. The tactile step is also preceded by the rotational resistance progressively increasing and the attachment element 120, 130 coupled to the filter being pulling toward the mask.

Returning to FIG. 13, when the user rotates the spring elements 118 in the wrong direction, the user detects a "stop" indication without an associated preceding "step" securing tactile indication. Also the stop indicating is detected without a preceding progressive increase in the rotational resistance and without the attachment element 120, 130 coupled to the filter being pulling toward the mask.

To disconnect the attachment elements 120, 130, the above process is reversed with the spring elements 118 rotated (e.g., counter clockwise). During dis-engagement, the hooking portions 121 rise up out of the locking zones 152 and travel in the reverse direction along the ledge 176. The spring elements 118 are rotated relative to the attachment shelf 14 until the hooking portions 121 are aligned with the slots 156 (as shown in FIG. 11).

The orientation in FIG. 11 may represent an initial preloaded orientation as well as a final detachment/dis-engagement orientation. For example, when disconnecting the attachment elements 120, 130, the attachment elements 120, 130 are rotated (e.g. counter clockwise) relative to one another until in the rotational orientation shown in FIG. 11, with the spring elements 118 aligned with the slots 156 between the attachment shelves 114. Once the spring elements 118 align with the slots 156, the spring elements 118 are removed and the attachment elements 120, 130 are separated.

It should be realized that the shelf 114 and spring elements 118 may have various configurations, including for example without limitation a gradually increasing attachment in both the radial and longitudinal/vertical directions, or a gradually increasing attachment in the longitudinal/vertical direction only. The combination of attachment shelves 114 and spring elements 118 allow the filter to be engaged to the mask at a wide variation in angle, i.e., no precise orientation required, and then twisted a short way to the fully attached and sealed position.

Figure 17:
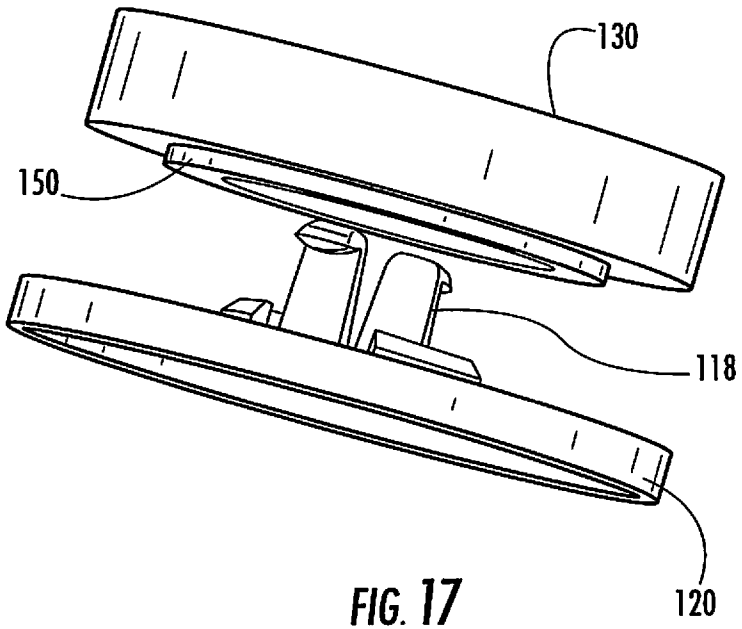
FIG. 17 illustrates a side perspective view of the attachment elements of FIG. 9.

FIG. 17 illustrates a side perspective view of the attachment elements 120, 130 of FIG. 9. The attachment element 130 includes a sealing barrier (e.g., a plastic or rubber seal). One or both of the attachment elements 120, 130 (FIG. 17) may include an elastomer sealing surface 150.

Figure 15:
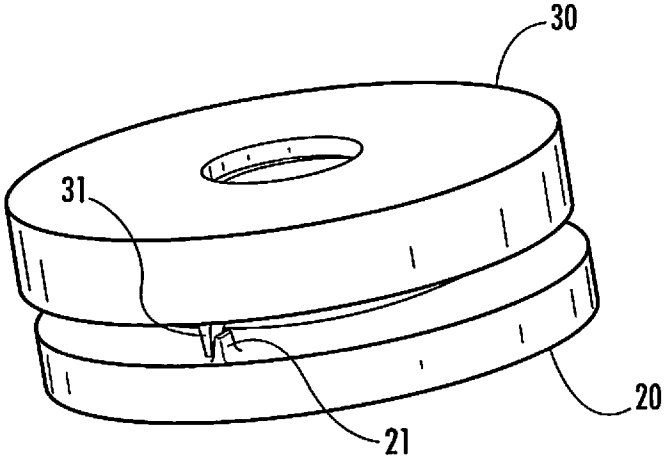
FIG. 15 illustrates a side perspective view of the attachment elements of FIGS. 1-6 when fully engages.
Figure 14:
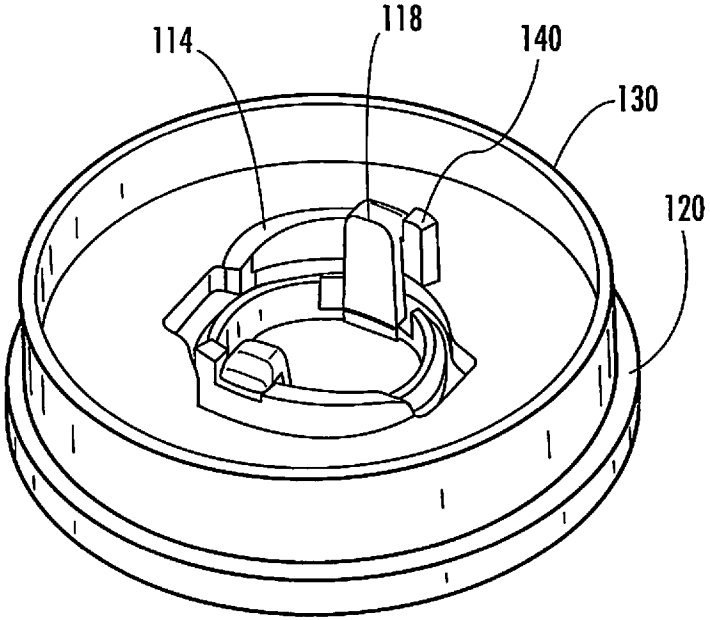
FIG. 14 illustrates the attachment elements of FIG. 9.

FIG. 15 illustrates a side perspective view of the attachment elements 20, 30 of FIGS. 1-6 when fully engages. The attachment elements 20, 30 include stop posts 21 and 31 provided on the mating faces 24, 34, respectively. The stop posts 21, 31 engage with one another to prevent over-rotation between the attachment elements 20, 30. For example, the stop posts 21, 31 may prevent reverse rotation in the wrong direction or excessive forward rotation past the fully engaged, locked and sealed stage/position.

The elements, such as the spring elements 12, 112 and attachment shelves 14, 114, work together, namely can be joined to one another, when the attachment elements 20, 30, 120, 130 are oriented with respect to one another in a wide range of initial orientation options. For example, the initial orientations may represent any orientation other than the orientation associated with the fully locked, engaged, sealed orientation. Hence, the initial orientation, at which the attachment elements are linearly mated with one another, may represent any non-final locked orientation. By way of example, a full range of orientation may be characterized as having a range of 180 degrees of orientation about the longitudinal axes 77,78, 177, 178. The spring elements and attachment shelves may define a locking zone that encompasses 10-15 degrees of the range of the 180 degrees of orientation. In this example, the attachment elements 20, 30, 120, 130 may be have a range of 165-170 degrees of acceptable initial orientations. The position and orientation in space of the filter (attachment element) are defined as the position and orientation, relative to the main reference frame of the mask (other attachment element). In geometric terms, the pitch, roll and yaw of one attachment element 20, 120 may vary over a broad range of values and remain mateable with the other attachment element 30, 130.

Both attachment elements 20, 30 may exist on either the filter or the mask, with one element 30 on the filter and the other element 20 on the mask. Preferably there is a mechanical stop (e.g., stop 40 in FIG. 8) that may be incorporated on either the mask or the filter, which indicates to the user that the filter is fully installed. This mechanical stop 40 can include, for example without limitation, a detenting mechanism which snaps the filter into final position, giving tactile feedback, and serving to provide extra resistance to reverse rotation, which helps prevent the filter from being uninstalled inadvertently. A sealing element 50 between the mask and the filter provides vertical spring force to allow the detent mechanism 40 to operate.

Incorporation of a flexible element into the filter attachment mechanism 100 allows the filter to be engaged to the mask with less precise orientation than other existing attachment methods, and then to be twisted only a short distance to the fully attached position.

As used throughout, the phrase "rotated relative" is not limited to any specific type of rotation, but instead shall include rotation of a first element relative to a second element that is stationary, rotation of the second element while the first element is held stationary, rotation of both the first and second elements simultaneously, rotation of the first element a partial distance while the second element is stationary followed by rotation of the second element a partial distance while the first element is stationary, and the like.

In accordance with embodiments described herein, a connection mechanism is provided that affords, among other technical effects, the technical effect of permitting the user more latitude and freedom when aligning and attaching a filter module to a respirator mask. The disclosed embodiments for connection mechanisms allow the user to introduce the attachment element of the filter assembly into the attachment element of the mask at various rotational and longitudinal orientations. The disclosed embodiments for connection mechanisms provide a range of acceptable rotational orientations when in the preloaded position. The disclosed embodiments for connection mechanisms also afford the technical effect of establishing a secure sealed interface with very limited additional manipulation of the filter by the user once the user completes the initial loading operation. The various embodiments for the spring element and attachment shelf provide "tactile" indicators to the user at each stage of the loading process. For example, once the spring element is inserted until reaching the intermediate loaded stage/position, spring element produces a "tactile" click or engagement feeling to inform the user that the filter is linearly inserted a sufficient distance to begin rotation. When the user rotates the filter, the spring element and attachment shelf interact to provide a tactile locking sound or feeling to inform the user that the filter is fully locked and sealed in the final engaged position with the mask.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions, types of materials and coatings described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112(f) unless and until such claim limitations expressly use the phrase "means for" followed by a statement of function void of further structure.

What is claimed is:

1. A respirator filter connection mechanism comprising:

a first attachment element;

a second attachment element;

an opening provided through each of the first attachment element and the second attachment element, the openings being aligned with each other when the first attachment element is coupled to the second attachment element;

one of the first attachment element and the second attachment element including a spring element located proximate to the opening through one of the first attachment element and the second attachment element, while another of the first attachment element and the second attachment element includes an attachment shelf located proximate to the opening;

the spring element configured to be linearly advanced into initial engagement with the attachment shelf until the spring element and attachment shelf couple to one another in an intermediate loaded position; and the attachment shelf having a cam feature that slidably engages the spring element and pulls the spring element from the intermediate loaded position into a locked and sealed position as at least one of the attachment shelf and spring element is rotated relative to the other of the attachment shelf and spring element.

2. The mechanism of claim 1, wherein the attachment elements include based areas having mating faces that extend about the attachment shelf and spring element, the attachment shelf and spring element drawing the mating faces into sealed direct contact with one another as the first and second attachment elements are rotated relative to one another.

3. The mechanism of claim 1, wherein the attachment shelf includes a wall and the cam feature includes a ledge provided on the wall, the spring element including a locking indentation that slides along the ledge to pull the first and second attachment elements into a locked and sealed position.

4. The mechanism of claim 1, wherein the spring element includes a U or C-shaped clip having locking indentations provide at outer distal ends thereof, the U or C-shaped clip fitting into a notch provided in one of the first and second attachment elements, the locking indentations engaging the cam feature.

5. The mechanism of claim 1, wherein the attachment shelf includes a base area extending laterally outward about a longitudinal axis, the attachment shelf further including a male nipple shaped flange element projecting from the base area in along the axis, the flange element including the cam feature, the cam feature including an embossment extending circumferentially about the flange element.

6. The mechanism of claim 1, wherein the spring element includes snap pins that extend outward from the first attachment element, the snap pins having lever arms that flex inward toward one another to pass through the opening in the second attachment element and through the attachment shelf, the snap pins including hooking portions that hook over the cam feature on the attachment shelf.

7. The mechanism of claim 1, wherein the second attachment element includes a base area extending about a longitudinal axis, the attachment shelf including walls that project from the base area and along the axis, the walls including a ledge forming the cam feature.

8. The mechanism of claim 7, wherein the spring element includes locking indentations that travel along the ledge to pull mating faces of the corresponding attachment elements toward one another in a sealing direction, an inter-operation of the ledge and the spring element introducing a sealing force applied between the first and second attachment elements during a rotational locking motion.

9. A method for connecting a respirator and a filter, the method comprising:

providing a first attachment element associated with a respirator mask;

providing a second attachment element associated with a filter;

aligning an opening through a first attachment element with an opening through a second attachment element;

locating a spring element proximate to the opening through one of the first attachment element and the second attachment element;

locating an attachment shelf proximate to the opening through another of the first attachment element and the second attachment element;

linearly advancing the spring element into initial engagement with the attachment shelf until the spring element and attachment shelf couple to one another in an intermediate loaded position; and rotating at least one of the spring element and attachment shelf relative to one another to cause the cam feature on the attachment shelf to slidably engage the spring element and pull the spring element from the intermediate loaded position into a locked and sealed position.

10. The method of claim 9, further comprising drawing mating faces on the first and second attachment elements into sealed direct contact with one another as the first and second attachment elements are rotated relative to one another.

11. The method of claim 9, wherein the attachment shelf includes a wall and the cam feature includes a ledge provided on the wall, the spring element including a locking indentation that slides along the ledge to pull the first and second attachment elements into a locked and sealed position.

12. The method of claim 9, wherein the spring element includes a U or C-shaped clip having locking indentations provide at outer distal ends thereof, the U or C-shaped clip fitting into a notch provided in one of the first and second attachment elements, the locking indentations engaging the cam feature.

13. The method of claim 9, wherein the attachment shelf includes a base area extending laterally outward about a longitudinal axis, the attachment shelf further including a male nipple shaped flange element projecting from the base area in along the axis, the flange element including the cam feature, the cam feature including an embossment extending circumferentially about the flange element.

14. The method of claim 9, wherein the spring element includes snap pins that extend outward from the first attachment element, the snap pins having lever arms that flex inward toward one another to pass through the opening in the second attachment element and through the attachment shelf, the snap pins including hooking portions that hook over the cam feature on the attachment shelf.

15. The method of claim 9, further comprising linearly advancing the spring element and attachment shelf toward one another from a pre-loaded stage to an intermediate loaded stage, rotating the spring element and attachment shelf relative to one another to advance from the intermediate loaded stage to the sealed and locked stage.

* * * * *